US007195211B2

(12) United States Patent
Kande et al.

(10) Patent No.: US 7,195,211 B2
(45) Date of Patent: Mar. 27, 2007

(54) ELECTRONICALLY CONTROLLED GRADE CROSSING GATE SYSTEM AND METHOD

(75) Inventors: Mallikarjun Shivaraya Kande, Bangalore (IN); Vidyadhar Kottisa, Bangalore (IN); David Michael Davenport, Niskayuna, NY (US); Pradeep Vijayan, Bangalore (IN); Kuna Venkat Satya Rama Kishore, Bangalore (IN); Kunal Ravindra Goray, Bangalore (IN); Raju Mogaveera, Bangalore (IN); Ramasamy Anbarasu, Bangalore (IN)

(73) Assignee: General Electric Company, Niskayuna, NY (US)

( * ) Notice: Subject to any disclaimer, the term of this patent is extended or adjusted under 35 U.S.C. 154(b) by 57 days.

(21) Appl. No.: 10/881,959

(22) Filed: Jun. 29, 2004

(65) Prior Publication Data

US 2005/0284987 A1 Dec. 29, 2005

(51) Int. Cl.
*B61L 29/00* (2006.01)

(52) U.S. Cl. ..... 246/473.1; 246/293; 246/125

(58) Field of Classification Search ..... 246/125, 246/126, 127, 272, 292, 293, 294, 295, 296, 246/313, 473.1; 49/49, 26, 28
See application file for complete search history.

(56) References Cited

U.S. PATENT DOCUMENTS 3,964,704 A 6/1976 Karr
3,987,989 A 10/1976 Geiger
4,090,685 A 5/1978 Pappas et al.
5,712,521 A * 1/1998 Detela ..... 310/162
5,834,914 A 11/1998 Moe et al.
6,105,905 A 8/2000 Spence
6,161,438 A * 12/2000 Mullet et al. ..... 73/774
6,267,332 B1 * 7/2001 Almblad ..... 246/294
6,307,339 B1 * 10/2001 Yourist et al. ..... 318/266
6,688,561 B2 2/2004 Mollet et al.
6,863,246 B2 * 3/2005 Kane et al. ..... 246/121

* cited by examiner

*Primary Examiner*—Mark T. Le
(74) *Attorney, Agent, or Firm*—Paul J. DiConza; William E. Powell, III

(57) ABSTRACT

An electronically controlled grade crossing gate system and method. The system includes a gate arm, a gate arm moving assembly, a position sensor assembly and a controller. The gate arm moving assembly is configured to move the gate arm and the position sensor assembly is configured to sense a position of the gate arm. The position sensor assembly is a non-contact position sensor assembly. The controller is coupled to the gate arm moving assembly and the position sensor assembly and it is configured to receive an incoming command related to the gate arm. The controller activates the gate arm moving assembly in response to the incoming command and communicates with the position sensor assembly to monitor the position of the gate arm.

29 Claims, 7 Drawing Sheets

ELECTRONICALLY CONTROLLED GRADE CROSSING GATE SYSTEM AND METHOD

BACKGROUND

The present invention generally relates to automatic grade crossing gate systems and more particularly to a system and method for electronically controlling and monitoring a grade crossing gate system.

Grade crossing gate systems are common means of warning and controlling approaching traffic at a highway-rail grade crossing or road-road crossing. Grade crossings where streets and railroad tracks intersect are notorious for collisions between roadway and rail vehicles. Various types of grade crossing warning systems are used to alert pedestrians and roadway vehicle operators about the presence of an oncoming train. Passive warning systems include signs and markings on the roadway that indicate the location of the crossing. Active warning systems include an audible signal from a locomotive horn and various types of wayside warning systems. Some of the grade crossing warning systems are activated by an approaching train and may include visual and audible alarms as well as physical barriers.

Typically, grade crossing warning systems are subject to normal equipment reliability and operability concerns. Reliable operation of such equipment is important for the safety of locomotives, vehicles and human life. In order to reduce the likelihood of equipment failures, routine maintenance and inspections are performed on grade crossing warning equipment. In particular, an inspector visits the site of each crossing periodically to inspect the equipment and to confirm its proper operation. Unexpected failures may occur in spite of such efforts, and such failures may remain undetected for a period of time.

Presently deployed grade crossing warning systems, such as, for example, the system illustrated in FIG. 1 mostly employ a mechanical arrangement to control a motor for opening and closing a gate arm. FIG. 1 shows an elevation view of a railroad crossing gate 10, which includes a mast or pole 14 having a base 16, which is securely fastened to a concrete foundation 18. The mast 14 supports and carries a cross-arm 26 bearing the words "Railroad Crossing", a warning bell 34, signal lamps 28. The mast 14 also supports and carries a controller unit 36 and an electrical junction box 38. Flexible connection 42 connects the controller 36 to the junction box 38. There is a series of warning lights 32 mounted on a gate arm 12. A counterweight 22 counteracts the weight of the gate arm 12 reducing the amount of mechanical power required of a motor in the controller 36 to raise and lower the gate arm 12, thereby making it feasible to use less-costly fractional or low horsepower motors. The gate arm 12 is coupled to a controller 36, which bi-directionally brakes the crossing gate arm travel movement. There is a pinion gear (not shown in the figure) inside the controller 36 that is driven by a motor. A main shaft 24 bearing a gear assembly runs through the controller 36. The pinion gear meshes with and drives a series of reduction gears. This gear assembly in turn drives the main output shaft 24, which in turn drives the gate arm 12 between its two extreme positions.

In a conventional system like this, typically a position detecting system is provided for detecting the position of the gate arm 12 during its motion. This type of position detecting system may take the form of cam operated contact fingers, a mercury level switch or any other type of system that is useful for determining the position of the gate arm 12.

The cam operated contact fingers are in contact with the gate arm 12 or the gear teeth inside the controller 36. The mechanical cams' profiles are designed in such a way that as the gate arm 12 moves, the mechanical contacts are closed and opened at appropriate intervals to activate different warning systems e.g. lights 32, and bell 34, etc. The mechanical cams and the switches are located inside the controller unit 36. The controller 36 is activated by a remote control unit or a wayside bungalow 44 with its own control unit 46. Flexible connection 48 connects the remote control unit 44 to the junction box 38.

Mechanical wear and tear of different subsystems and components as well as the chance of breakage and fracture of the gate arm 12 put a limit on the reliability and operability of the system shown in FIG. 1. Moreover, periodic manual inspection of grade crossing gate systems per Federal Railroad Administration (FRA) regulations is an expensive process. Moreover, a problem with manually inspecting this type of grade crossing gate system is that it is expensive to send a maintenance engineer out to all of the sites that have such a system to do an inspection on a yearly or monthly basis. Also, faults in the system sometimes are not noticed in a timely manner; sometimes not until an accident has occurred.

In order to overcome the above-mentioned problems, there is a need for an approach that can automate the control and monitoring of the railroad grade crossing gate systems, especially by communicating with a remote site. With approximately 60,000 railroad crossings with active warning systems in the United States, the ability to remotely monitor would improve safety since problems in the grade crossing gate system could be reported as they occur and fixed very soon thereafter. Cost, time and effort associated with inspection of the railroad crossing grade crossing gate systems would likely decrease because maintenance engineers would not have to go to each crossing site to inspect grade crossing gate systems; only to the ones that were noted as faulty.

SUMMARY

Briefly, in accordance with one embodiment of the invention, there is provided a system for electronically controlling a grade crossing gate system. The system includes a gate arm, a gate arm moving assembly, a position sensor assembly and a controller. The gate arm moving assembly is configured to move the gate arm and the position sensor assembly is configured to sense a position of the gate arm. The position sensor assembly is a non-contact position sensor assembly. The controller is coupled to the gate arm moving assembly and the position sensor assembly and it is configured to receive an incoming command related to the gate arm. The controller activates the gate arm moving assembly in response to the incoming command and communicates with the position sensor assembly to monitor the position of the gate arm.

In accordance with another embodiment of the invention, there is provided an electronic system for controlling a grade crossing gate. The system includes a gate arm, a gate arm moving assembly, a position sensor assembly, a controller and a remotely located control unit. The gate arm moving assembly is configured to move the gate arm and the position sensor assembly is configured to sense a position of the gate arm. The position sensor assembly is a non-contact position sensor assembly. The controller is coupled to the gate arm moving assembly and the position sensor assembly and it is configured to receive an incoming command related to the gate arm. The controller activates the gate arm moving assembly in response to an incoming command and communicates with the position sensor assembly to monitor the position of the gate arm. The remotely located control unit is configured to communicate with the controller to control and monitor the operation of the gate arm, the gate arm moving assembly, the position sensor assembly and/or the controller.

In accordance with another embodiment of the invention, a method is provided for electronically controlling a grade crossing gate system having a gate arm. The method includes sensing a position of the gate arm by non-contact means and controlling a movement of the gate arm in accordance with an incoming command related to the gate arm.

These and other features, aspects, and advantages of the present invention will become better understood when the following detailed description is read with reference to the accompanying drawings in which like characters represent like parts throughout the drawings.

DETAILED DESCRIPTION OF EXEMPLARY EMBODIMENTS

While embodiments of the invention are described with reference to a gate system found at a highway-rail grade crossing, the principles of the invention are not limited to such gate systems. One of ordinary skill will recognize that other embodiments of the invention are suited for other types of gate systems such as traffic gate systems that are generally installed at intersection approaches in order to control the flow of automobiles and pedestrians or at inspection points near tollgates or traffic check points.

Figure 1:
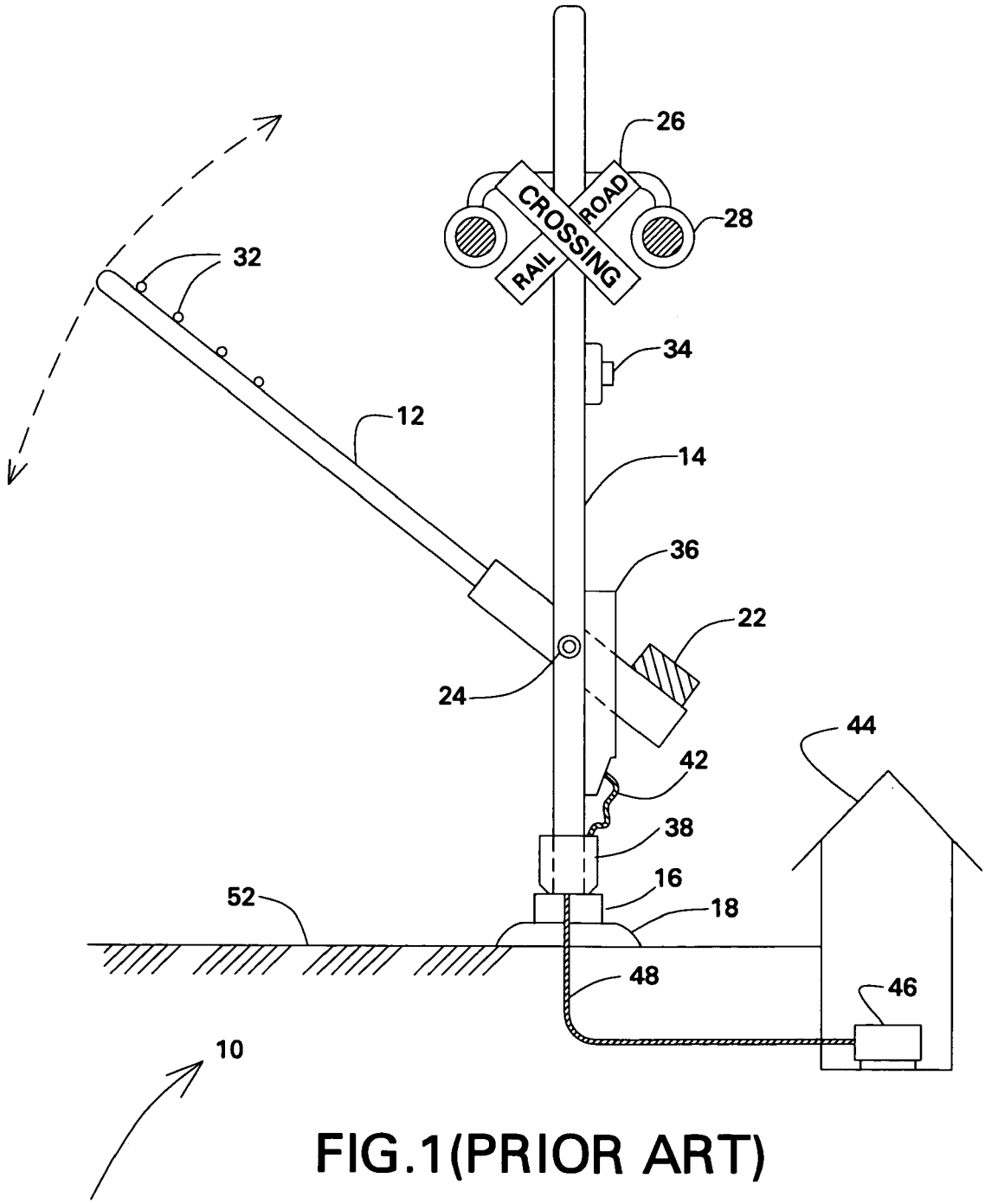
FIG.1(PRIOR ART)
FIG. 1 is an elevation view of a conventional grade crossing gate system.
Figure 2:
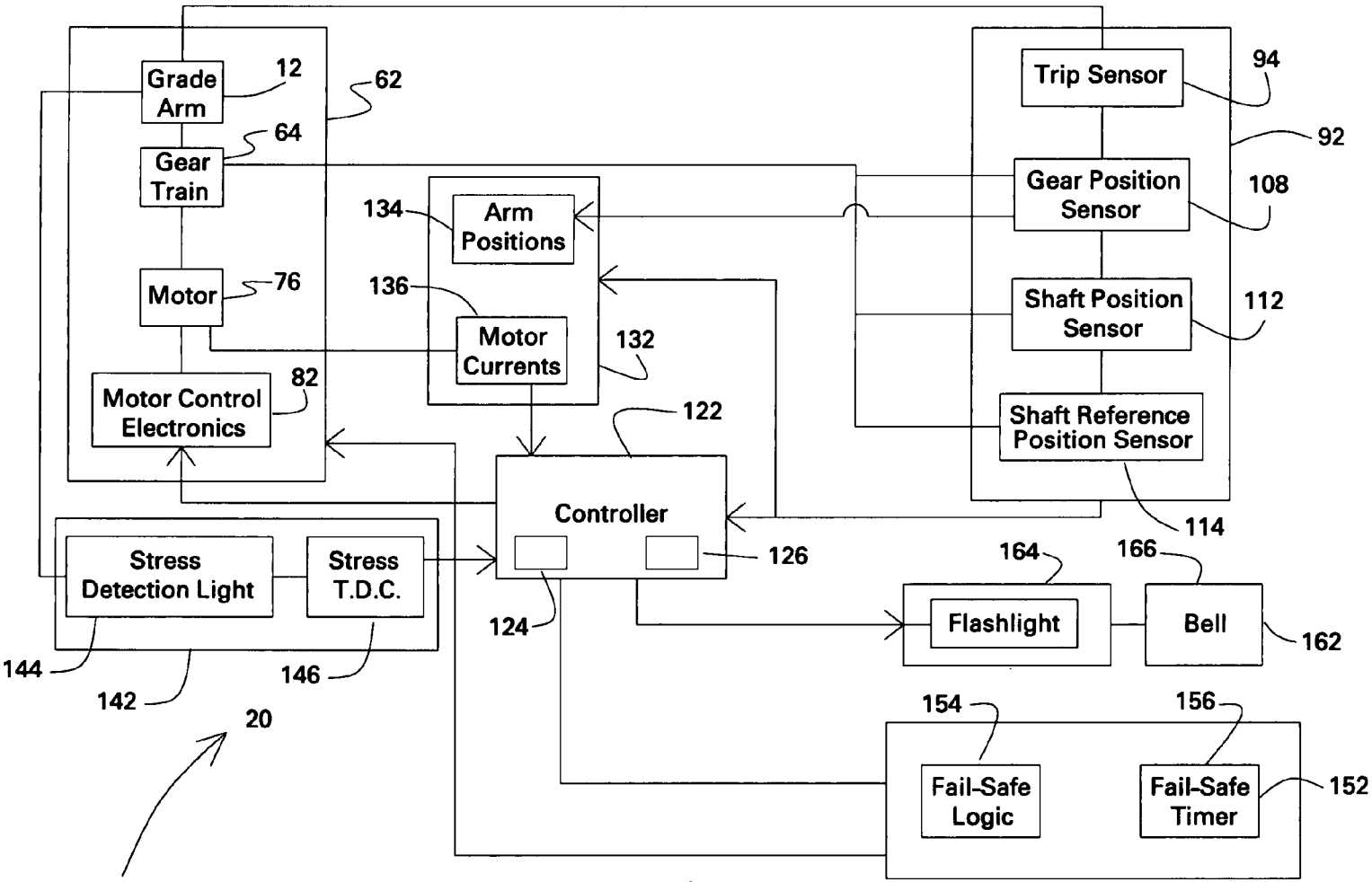
FIG. 2 is a block diagram of a grade crossing gate system constructed in accordance with an exemplary embodiment of the invention.

FIG. 2 is a block diagram of a grade crossing gate system 20 constructed in accordance with an exemplary embodiment of the invention. The system includes a gate arm moving assembly 62 that moves the gate arm 12, a position sensor assembly 92 that tracks the position of the gate arm 12 in motion and a gate arm safety monitoring system 142 that monitors the safety of the gate arm 12. The system 20 further includes a gate arm intrusion sensing assembly 132 that checks if anything comes in the way of the gate arm 12 and a controller 122 that controls and coordinates the overall functioning of the system. The system 20 also includes fail-safe electronics 152. The fail-safe electronics 152 works in parallel with the controller 122 at all times and ensures that the most important and basic operations of the grade crossing gate system 20 (e.g. bringing the gate arm 12 to an upright position as a default configuration) are executed even in case of any fault with the controller 122. The system 20 further includes warning system 162 that is used in general to warn the roadway traffic.

Figure 3:
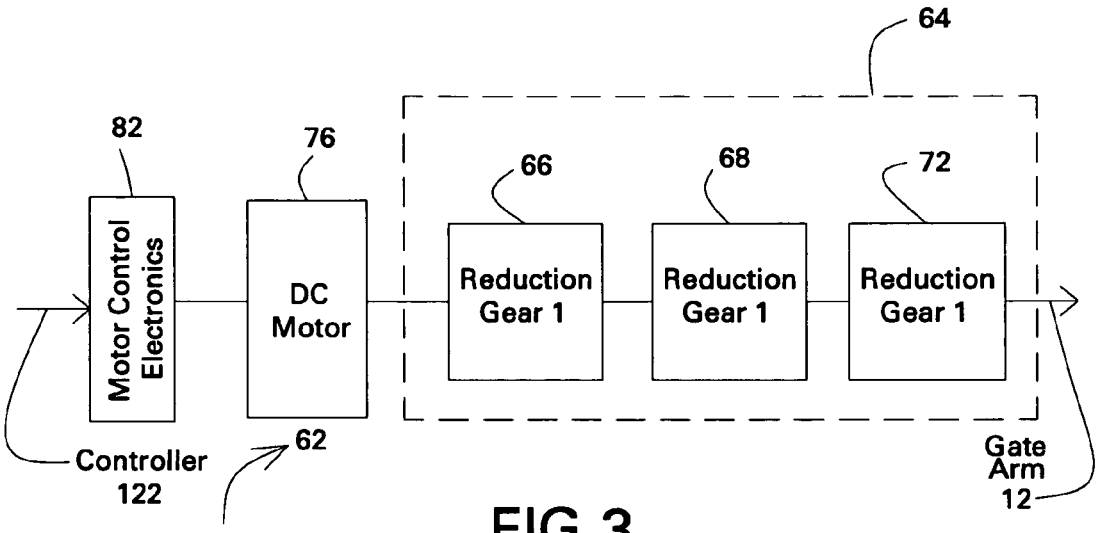
FIG. 3 is a block diagram of a gate arm moving assembly shown in the system of FIG. 2.

FIG. 3 is a block diagram of one embodiment of the gate arm moving assembly 62 of FIG. 2. The gate arm moving assembly 62 uses motor control electronics 82, a motor 76 and a gear assembly 64 to move the gate arm 12. The motor 76 is driven to rotate the main shaft on which gate arm 12 is held. This application demands a high torque (e.g., about 150 Newton meter) at very low speeds (e.g., 1–2 revolutions per minute). In one embodiment of this invention, this is achieved by means of multi-stage gear reduction, which reduces the speed and steps up the torque. Motor control electronics 82 receives a signal from the controller 122 and controls the speed of the motor 76. The motor 76 in turn moves the gear assembly 64.

In this embodiment of the invention, a brushed/brushless DC gear motor is used with additional step down gears at the output of the motor to further reduce the speed to the required level of 1–2 rpm. In this scheme there are multi-level gear reductions from the motor output to the final shaft. For instance, there are three reduction gears in series being driven by the motor 76—a first reduction gear 66, a second reduction gear 68, and a third reduction gear 72. The gate arm 12 is driven in the up or down direction by the output shaft of the third reduction gear 72.

Another embodiment of the invention involves the use of a transverse flux machine 78 to achieve the appropriate torque-speed combination using at the maximum a single stage gear reduction. Transverse flux machine technology is capable of producing high torque with a high torque-to-weight ratio for the machine. This embodiment of the invention involves the use of this high torque machine specifically for driving the gate arm 12. Since this machine is capable of generating high torques, it can be used to directly drive the gate arm 12 without any gear or with a maximum of single stage gear. Moreover, this is an embodiment of the invention where the space required is reduced.

Figure 4:
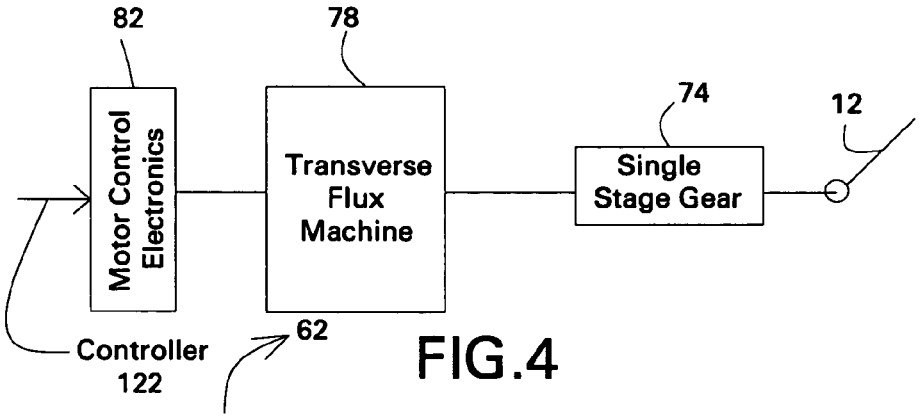
FIG. 4 is a block diagram of the gate arm moving assembly of the system of FIG. 2 with a transverse flux machine as the motor.

FIG. 4 shows a block diagram of the gate arm moving assembly 62 of FIG. 2 with a transverse flux machine 78 as the motor. Motor control electronics 82 receives a signal from the controller 122 and controls the speed of the transverse flux machine 78. The transverse flux machine 78 drives the gate arm 12 using the single-stage gear 74.

The transverse flux machine 78, when used with a single stage gear or with no gear occupies much less space as compared to a conventional DC motor with multi-stage gear reductions. The overall efficiency is higher as the number of gears is reduced or eliminated. The transverse flux machine 78 and the single stage gear 74 can be mounted directly on the shaft on which the gate arm 12 is mounted so that assembly is easier. The number of parts is reduced and the system 20 has a high reliability. Reduced requirements for space due to elimination of multiple gears improves system efficiency because of a reduction in number of gear stages. Also, system integration becomes easier as there are fewer parts to put together. In addition, accurate position and speed control is possible by closed loop control of the transverse flux machine 78. Moreover, system complexity is reduced due to far less number of mechanical components. Reliability is increased due to reduction in the number of mechanical parts. This embodiment also achieves a reduction in fabrication costs.

In operation, the gate arm moving assembly 62 of both FIG. 3 and FIG. 4 embodiments receives an incoming command related to the gate arm from the controller 122. The signal in these embodiment is a Pulse Width Modulated (PWM) signal and it is generated by a micro-controller 124 in the controller 122 and is used to vary the speed of the motor 76 in FIG. 3 or the transverse flux machine 78 in FIG. 4 through a solid state driver (not shown), which in turn moves the gate arm 12. A command from the wayside bungalow 44 determines whether the gate arm 12 has to be lowered (i.e., closed) or kept in vertical position (i.e., opened). Once the controller 122 receives a command either to open or close, the motor 76 or the transverse flux machine 78 is activated to position the gate arm 12 accordingly.

While operating the gate arm 12 as described above, at times it is necessary to stop the movement of the gate arm 12 like while holding the gate arm 12 stationary in a vertical position or when the movement of the gate arm 12 is obstructed by an intrusion. This function is achieved by braking the motor 76 in FIG. 3 or the transverse flux machine 78 in FIG. 4. Each of the motor 76 and the transverse flux machine 78 has a brake (not shown) that is applied to the rotating shaft of the motor 76 or the transverse flux machine 78 respectively. The brake, in each case, is electronically controlled by the controller 122 with the help of a solenoid (not shown). In a default position of the gate arm 12, the solenoid is activated and the gate arm 12 is held stationary in a vertical position. Then, at a time of closing the gate, i.e. when the gate arm 12 has to be lowered, the controller 122 deactivates the solenoid, releases the brake and then runs the motor 76 or the transverse flux machine 78 in a forward direction. This brings the gate arm 12 to a 'closed' or horizontal position. Again, when the gate has to be opened and the gate arm 12 has to be raised, the motor 76 or the transverse flux machine 78 is made to run in a reverse direction till the gate arm 12 comes to a vertical position. At the end of the travel of gate arm 12, i.e. at the vertical position, the solenoid is activated again, the brake is applied and thereby the gate arm 12 is held stationary in the vertical position. This configuration of the brake ensures a fail-safe operation during power failure. When power fails, the solenoid automatically gets de-activated and thereby releases the brake. The gate arm 12 comes down by its own weight and rests in a horizontal position. A counterweight (not shown) nearly balances the weight of the gate arm 12 and slows down the downward motion of the gate arm 12.

Figure 5:
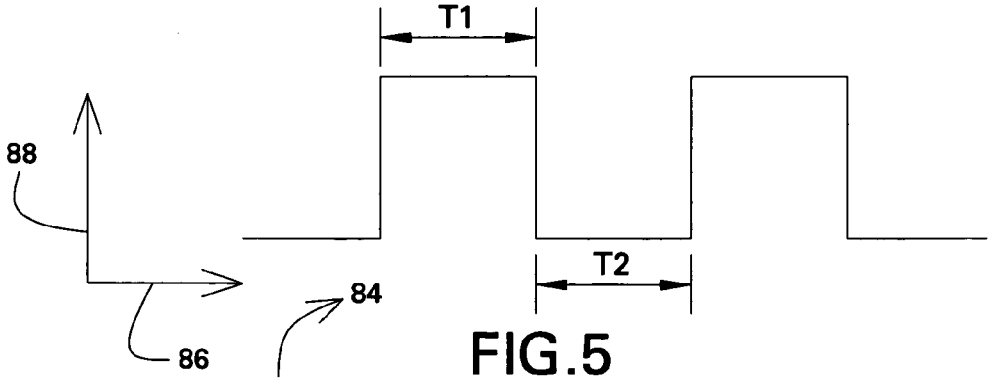
FIG. 5 is a schematic diagram of a pulse width modulated signal sent by a controller shown in the system of FIG. 2 to drive the motor in the gate arm moving assembly at varying speeds.

FIG. 5 is a schematic diagram of a PWM signal 84 sent by the controller 122 to drive the motor 76 or the transverse flux machine 78 at varying speeds. The horizontal axis 86 represents a time axis of the PWM signal 84 and the vertical axis 88 represents a voltage axis of the PWM signal 84. The figure represents the changing pulse value over time. T1 is the cycle time when power is supplied and T2 is the cycle time when power is not supplied. The duty cycle of the signal 84 is T1/(T1+T2). Speed of the gate arm 12 is varied by controlling the duty cycle of the PWM signal 84.

Referring back to FIG. 2, the position of the gate arm 12 in motion is continuously tracked by the controller 122 by deploying another subsystem—the position sensor assembly 92. The position sensor assembly 92 includes a tip position sensor 94, a gear position sensor 108, a shaft position sensor 112, and a shaft reference position sensor 114. The position of the gate arm 12 is continuously monitored and tracked by position sensor assembly 92 to activate warning systems at different predetermined positions of the gate arm 12. The position of the gate arm is sensed right from the vertical position, i.e., 90 degrees, to the horizontal position, i.e., 0 degrees. The flashlight 164 and bell 166 are also activated at pre-programmed positions to activate their operations appropriately with the help of solid-state switch. The up/down indications sensed from tip position sensor 94 are sent back to the controller 122 and logged for the gate operations.

Figure 6:
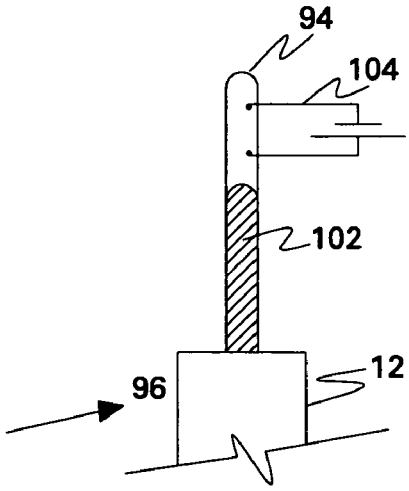
FIG. 6 is a schematic diagram of a tip position sensor within the position sensor assembly that is in a vertical orientation.
Figure 7:
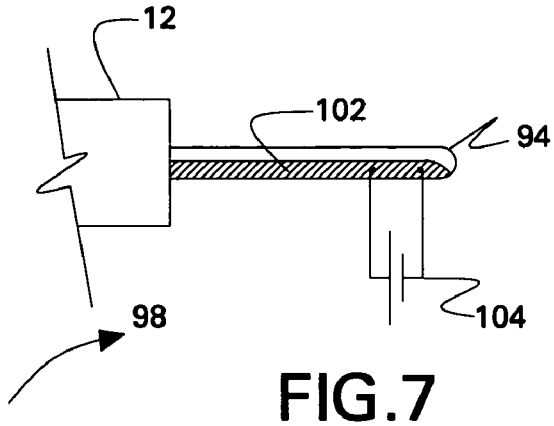
FIG. 7 is a schematic diagram of the tip position sensor in a horizontal orientation.

FIG. 6 is a schematic diagram of the tip position sensor 94 in a vertical orientation. In the vertical orientation 96, the tip position sensor 94 comprises a tube of mercury 102 and mercury switch 104 embedded in the tube. In the vertical orientation, the mercury level falls below the mercury switch 104 and as a result the circuitry 104 remains electrically open. An altered situation is illustrated in FIG. 7, which is a schematic diagram of the tip position sensor 94 in a horizontal orientation 98. In the horizontal orientation 98, the mercury flows over the mercury switch 104. Mercury being a metal, the circuit 104 gets closed and the position of the arm is sensed as horizontal.

Figure 8:
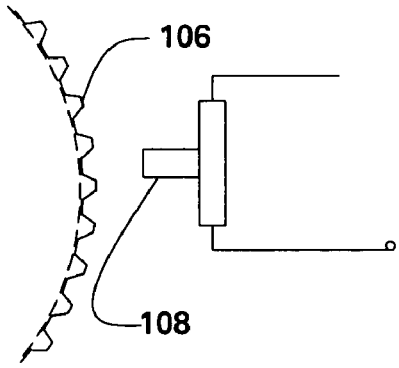
FIG. 8 is a schematic diagram of a gear position sensor within the position sensor assembly with a gear tooth sensor.

FIG. 8 is a schematic diagram of the gear position sensor 108 of the system of FIG. 2 with a gear tooth sensor. The gear position sensor 108 is a proximity sensor mounted in alignment with gear tooth teeth 106 in the system 20. In operation, when a motion generating gear of the gear assembly 64 rotates to move the gate arm 12 up/down, the teeth 106 of the gear pass in front of the proximity sensor 108 one after another. Every time a gear tooth 106 passes in front of the proximity sensor 108, the proximity sensor 108 senses the movement and produces an output pulse. The output pulses from the proximity sensor 108 are sent to an electronics read-out logic (not shown), which is a part of the controller 122. The electronics read-out logic counts the number of output pulses and determines the angular position of the gate arm 12 from the number of output pulses. In this embodiment, an existing gear is used as a sensing element and so no extra position encoder is required.

An alternative to the embodiment described above, is to use the gear tooth sensor 108 to sense direction and speed apart from the pulse per tooth of the gear. As explained below, the gear tooth sensor 108 can be configured to receive the position count of the gate arm in three different ways in three different embodiments of the invention In a first embodiment, the two-channel gear tooth sensor 108 is a 'quadrature' sensor. The quadrature sensor has two sensing elements inside the sensor, and it produces two digital pulses per tooth. Channel A leads channel B by 90 degrees if the gear spins clockwise. Channel B leads channel A by 90 degrees if the gear spins counter-clockwise. There are quadrature counters available that can resolve the two channels and sense that when traveling clockwise, the counter should see, in order, Channel A—low to high, Channel B—low to high, Channel A—high to low, Channel B—high to low. On any deviation from this order, the counter is programmed to subtract this count and not to add it. So, if the gear chatters, and for instance Channel A goes high, then low, then high, then low, etc., the counter counts up/down/up/down, etc. and the true position stays.

In a second embodiment, gear tooth sensor 108 is a two-channel sensor with a 'D flip flop' Speed/Direction sensing element. Gear tooth sensor 108 has two digital outputs, one is one pulse per tooth, and the other is direction. When the gear spins clockwise, the direction signal is 'low'. When the gear spins counter-clockwise, the direction signal is 'high'. This sensor operates with the same two elements as described above. Inside this sensor, there is a D flip flop (Dff) logic element where Channel A is the input to 'D', and the flip flop is clocked with the rising edge of channel B. When spinning, the direction signal is updated once per tooth.

In a third embodiment, the gear tooth sensor 108 is a 'Quadrature Counter' with speed and direction sensor elements. It starts with the two elements and pulses 90 degrees apart. This sensor again produces two digital outputs for speed and direction. Unlike the D flip flop speed/direction sensor described above, this sensor updates direction four times per tooth (every edge). Even if the gear chatters at times, the speed and direction sensors are able to distinguish the two digital output pulses.

In yet another embodiment of the invention, the position sensor assembly 92 can also be configured to sense any backlash effect or a jerk of the gate arm 12. The position sensor assembly 92 of this embodiment offers a low cost and low maintenance solution for the practical problems of distinguishing a backlash or a jerk of the gate arm 12 from a substantial change in position of rest or motion of the gate arm 12. In another embodiment, an external gear system can also be used along with a proximity sensor. For instance, a gear tooth sensor 108 and its read-out electronics (not shown) can be used to sense the position of the gate arm 12. The read-out electronics is part of the controller 122. In yet another embodiment of this invention, the gear tooth sensor 108 can be any other type of proximity sensor, for instance, an eddy current sensor or a Hall effect sensor or a magneto-resistive sensor.

Figure 9:
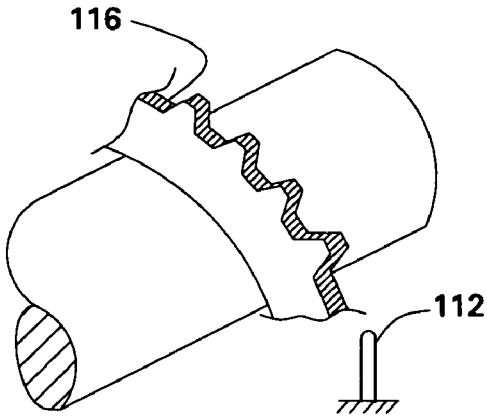
FIG. 9 is a schematic diagram of a shaft position sensor within the position sensor assembly with an encoder disk having continuous pattern cuts.

In addition to the gear position sensor 108, the position sensor assembly 92 also deploys a shaft position sensor 112 and a shaft reference position sensor 114 to track the angular position of the shaft. In one embodiment, an incremental encoding method is followed and absolute position of the shaft is detected. Accordingly, as the gate arm 12 moves from its reference, the shaft position sensor 112 produces the pulses per unit distance movement. FIG. 9 is a schematic diagram of the shaft position sensor 112 of the system of FIG. 2 with an encoder disk 116 having continuous pattern cuts. In another embodiment of the invention, absolute switching uses a metallic cam type disk 116, such that whenever an edge of the disk 116 crosses a shaft position sensor 112, the sensor produces a change in its output. The sensor output is used to detect the angular position of the shaft. The metallic cam type disk 116 in this embodiment has continuous pattern cuts along its circumference. Every time this pattern crosses the sensor 112, it produces a pulse due to unit angular rotation of the main shaft. The position of the gate arm 12, as measured from a reference is directly proportional to the pulse count. The electronic read-out logic (not shown) is part of the controller 122 and it senses the pulses to give out the exact angular position of the shaft in degrees. That is also the angular position of the gate arm 12.

Figure 10:
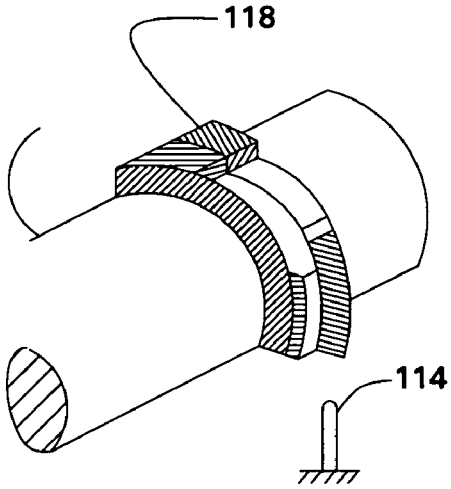
FIG. 10 is a schematic diagram of a shaft reference position sensor within the position sensor assembly with an encoder disk having predetermined angle cuts.

In another embodiment of the invention, the position sensor assembly 92 uses an absolute position detection technique to sense the position of the gate arm 12. FIG. 10 is a schematic diagram of the shaft reference position sensor 114 of FIG. 2. An encoder disk 118 with a pattern cut all along its outer circumference is used in this embodiment of the position sensor assembly 92. In another embodiment, the encoder disk 118 can have a 90 degrees sector cut along its circumference. The depth of the cut can vary from one embodiment to another. In one embodiment, the depth of the cut can be the full the thickness of the encoder disk. In another embodiment, the cut can be less than the thickness of the encoder disk. In operation, whenever the cut-edge of the encoder disk 118 passes the sensor 114, the sensor output changes. In another embodiment, a number of encoder disks 118 can be aligned and mounted on the main shaft to get differential angular measurement of the shaft.

In operation, the position sensor assembly 92 is used for activating different warning systems of the grade crossing gate system 20. The position sensor assembly 92 uses the output pulses from the gear tooth sensor 108 of the grade crossing gate system 20 to sense the position of the gate arm 12 by using the following relationship:

Position of the gate arm in degrees=count×angle between two teeth.

This embodiment of the invention is capable of position detection at any required angle. It is also easy to adjust the position of the encoder disks to any required angle. The operation is completely non-contact position sensor in method and switching.

The signals sent from the position sensor assembly 92 to the controller 122 can also be used to activate different warning systems of the railroad grade crossing gate system 20. Referring back to FIG. 2, the warning system 162 includes a warning flashlight 164 and a warning bell 166. Timing of the warning systems 164 and 166 depends on the position of the gate arm 12 as sensed by the position sensor assembly 92. The gate system 20 uses the position of the gate arm 12 to activate the warning system. The position of the gate arm 12 is also used to control the motor, which drives the gate arm main shaft using external gear. This embodiment of the invention uses the position sensor assembly 92 that in turn uses the existing gear of the gate system 20 to get the position of the gate arm 12 in degrees.

The invention is not limited to the above-described functions of the position sensor assembly 92. The position sensor assembly 92 can also be configured to sense any backlash effect or a jerk of the gate arm 12. The position sensor assembly 92 indicates speed, direction and position of the gate arm 12. These extra parameters can be used for motor control and safety logics to improve the performance of the whole grade crossing system 20. In another embodiment, a combination of data obtained from the position sensors 94, 108, 112 or 114 can also be used to sense a situation where the gate arm 12 is inadvertently intercepted on its motion.

Referring back to FIG. 2, the gate arm safety monitoring system 142 monitors the safety of the gate arm 12 from any potential damage all through its motion. The gate arm safety monitoring system 142 includes a stress detection system 144 and a stress threshold detection circuitry 146. The stress detection system 144 determines the stress level at the base of the fixture holding the gate arm 12. The stress threshold detection circuitry 146 is analog circuitry that compares the stress level sensed with a predetermined threshold value and sends an appropriate warning signal that the gate arm 12 is damaged. The stress threshold detection circuitry 146 is also used to send this information back to the way-side bungalow 44 for immediate replacement of the gate arm 12 to enhance the safety of road vehicles. In other embodiments of the invention, the gate arm safety monitoring system 142 may have the capability of detecting the strain variation at the shear joint bolts of the railroad crossing gate arm 12. In this embodiment, the stress detection system 144 would be placed in a way so that the sensitivity is optimum and the routing the electrical wiring does not interfere with the operation of the gate arm 12.

In operation, the gate arm safety monitoring system 142 is deployed to detect any breakage or bending of the gate arm 12. This information is used for taking necessary corrective actions. The gate arm 12 is designed in such a way that it tears off at a shear joint bolts position to protect the supporting controller 122 in the event of a vehicular collision. The stress detecting system, which may be a strain gauge 144, is placed at the base of the gate arm 12 and the outputs are sent to the stress threshold detection circuitry 146. Under break or bend situations, a finite amount of stress is generated at the shear joint bolts position. This is detected by the stress threshold detection circuitry 146 and, subsequently, a break or bend decision is formulated. The placing and routing of strain gauges at the shear joint bolts position is done in such a way that optimum sensitivity to the breakage or bending of the gate arm 12 is detected. This arrangement does not affect the intended operation of gate arm 12. It should be appreciated that other types of stress detecting elements can also be used.

Referring back to FIG. 2, the gate arm intrusion sensing assembly 132 continuously monitors whether there is any potential intrusion into the path of motion of the gate arm 12. The gate arm intrusion sensing assembly 132 includes an arm position sensor 134 and a motor current sensor 136. The gate arm 12 uses itself as an antenna and initiates the micro-power radio frequency (RF) radiation only during operation of gate system, i.e., while closing and opening the gate. If any object comes in the vicinity of gate arm 12 and intercepts the RF waves, the reflected RF waves indicate that an obstructing object is present. This detection is further used in the grade crossing gate system 20 to give feedback to the warning system 162 and to initiate necessary contingency warning action. The gate arm intrusion sensing assembly 132 improves the fault diagnosis and control of the grade crossing gate system 20.

In operation, the highway grade crossing gate system 20 lowers its arm 12 to block vehicle access and raises its arm 12 to an upright position to permit vehicle access across a railroad crossing. During its operation, vehicles, pedestrians or any other objects can come under the gate arm 12 and therefore can block the operation of gate system 20 to close/open the gate. Sometimes, a vehicle or a pedestrian may pass through the 'entry' gate and then get stranded in between the 'entry' and the 'exit' gates. In one embodiment of the invention, a method is described by which objects causing gate arm intrusion and thereby hindering the operation of grade crossing gate system 20 can be identified. In case of any intrusion, the gate arm intrusion sensing assembly 132 senses the position of the gate arm 12 using the arm position sensor 134. At the same time, the gate arm intrusion sensing assembly 132 also senses the motor current flowing through the motor 76 using the motor current sensor 136. If the position of the arm 12 is sensed to be unchanging and if at the same time the motor current tends to increase, it indicates that the motor 76 is trying to overcome a resistance on the motion of the gate arm 12. The intrusion on the gate arm 12 is thus confirmed. This is a proactive method of detection of intrusion where the detection happens before any contact between an intruding object and the gate arm 12.

It should be appreciated that other embodiments of the invention include passive methods of detection of intrusion and in still other embodiments, intrusion is detected after the contact happens.

Referring back to FIG. 2, the fail-safe electronics 152 take over the command from the controller 122 in time of a power failure and failure of any other kind. Fail-safe electronics 152 include fail-safe logic circuitry 154 and a fail-safe timer 156. The fail-safe electronics 152 uses discrete hardware to complement the controller 122, which takes care of a minimum required operation of the gate system 20 during failure of the micro-controller 124. One such operation is bringing the gate arm 12 down to a horizontal position during a failure. The fail-safe timer 156 synchronizes the operation of the fail-safe logic circuitry 154 in keeping with an internal clock. Embodiments of the invention are not limited to the above-described functionalities of the fail-safe electronics 152. There are many other fail-time operations that can be performed by the fail-safe electronics 152 such as activating the warning system 162 and its components like the flashlight 164 and warning bell 166.

Referring back to FIG. 2, the controller 122 is the central unit that controls and coordinates all the activities of the grade crossing gate system 20. The controller 122 includes a micro-controller 124 and a solid state switch 126 configured to communicate in power-line communication mode. The micro-controller 124 is an analog-to-digital converter accessible through all analog input port. The function of the micro-controller 124 is to convert the analog D.C. voltage to a digital format recognizable by the central processing unit.

In operation, the micro-controller 124 in the controller 122 has two modes—"operation mode" and "maintenance mode". The mode is selected using a maintenance switch operated by the maintenance/operational engineer. In "operation mode", the controller continuously tracks for the external command. If the gate system 20 is commanded to lower the gate arm 12, then the controller 122 generates a pulse width modulated (PWM) signal to drive the motor to horizontally position the gate arm 12. In "maintenance mode", field data and a maintenance log in a flash memory are accessed using a hand held system or by a remote terminal. Field programmability improves the maintenance of the system and helps in developing maintenance information related to the lifetime management of the grade crossing gate system.

Embodiments of the invention are not limited to the above-described configuration of the micro-controller 124. In other embodiments, the controller 122 may include solid-state equipment, relays, microprocessors, software, hardware, firmware, etc. or combinations thereof. The controller 122 includes logic for activating the gate arm moving assembly 62 in coordination with the position sensor assembly 92. This way, the controller 122 moves the gate arm 12 and at the same time, tracks the position of the gate arm 12 in motion by using a non-contact position sensor methodology as described above. The logic of operation of the controller 122 also includes coordination with the operation of the gate arm safety monitoring system 142 for monitoring the safety of the gate arm 12 and coordination with the operation of the gate arm intrusion sensing assembly 132 for detecting if anything comes in the way of the gate arm 12. In case of any intrusion on the gate arm 12, the controller 122 matches the output of the position sensor assembly 92 with the motor current sensor to determine whether there is any increase in the motor current and thereby ascertains any intrusion. All other read-out logic circuits in the system 20 are structurally and functionally part of the controller 122. The controller 122 activates appropriate fail-time or warning alerts if a threshold level of any excitation is exceeded. The command signals issued by the controller 122 may take the form of a simple go/no-go decision wherein proper and improper performances are differentiated. Alternatively, more robust information may be developed depending upon the type of situation being monitored, the sophistication of the sensor involved and logic performed by controller 122. For example, a history of field or performance data may be recorded with future performance being predicted on the basis of the data trend. For audio performance data, the information may include volume, frequency, and pattern of sound verses time. For visual performance data, the information may include wavelength, intensity and pattern of light verses time. One may appreciate that the information stored by the controller 122 is directly responsive to known failure modes and performance characteristics of the particular type of situation being monitored.

In another embodiment of the invention, the controller is equipped with power-line communication enabled circuitry 126 to communicate in power-line communication mode. Power-line communication mode is explained below in greater details. In yet another embodiment of the invention, the controller 122 may be equipped to communicate with contact based sensing operations. In yet another embodiment of the invention, the controller 122 may be located outside the grade crossing system and within a wayside equipment box near the grade crossing gate system 20.

Field data and maintenance log are stored in non-volatile memory connected to the controller 122. The data are accessed using a hand held system or by a remote control unit 44 for further analysis. For instance, a change in the time interval between the delivery of a command signal and the operation of the gate arm 12 may be indicative of a developing problem. Early recognition of a change in the system characteristics may permit problems to be fixed before they result in a condition wherein the component or a subsystem fails to respond in a safe manner.

In another embodiment of the system, microcontroller 124 of the gate arm controller 122 is enhanced with an additional feature of 'field programmability'. This feature ensures that the software program of the microcontroller 124 can be readily changed or updated when needed. The need to change or update the program may arise, for instance, when a fault is diagnosed in the previous version of the program or a change takes place in an operating regulation of FRA or a new regulation is brought in force, etc. Moreover, the software program of the microcontroller 124 can be changed or updated using a hand-held system or from a remote control unit. The 'field programmability' feature eliminates the need to uninstall the whole controller 122 or its microcontroller 124 and send it to a factory for maintenance.

Figure 11:
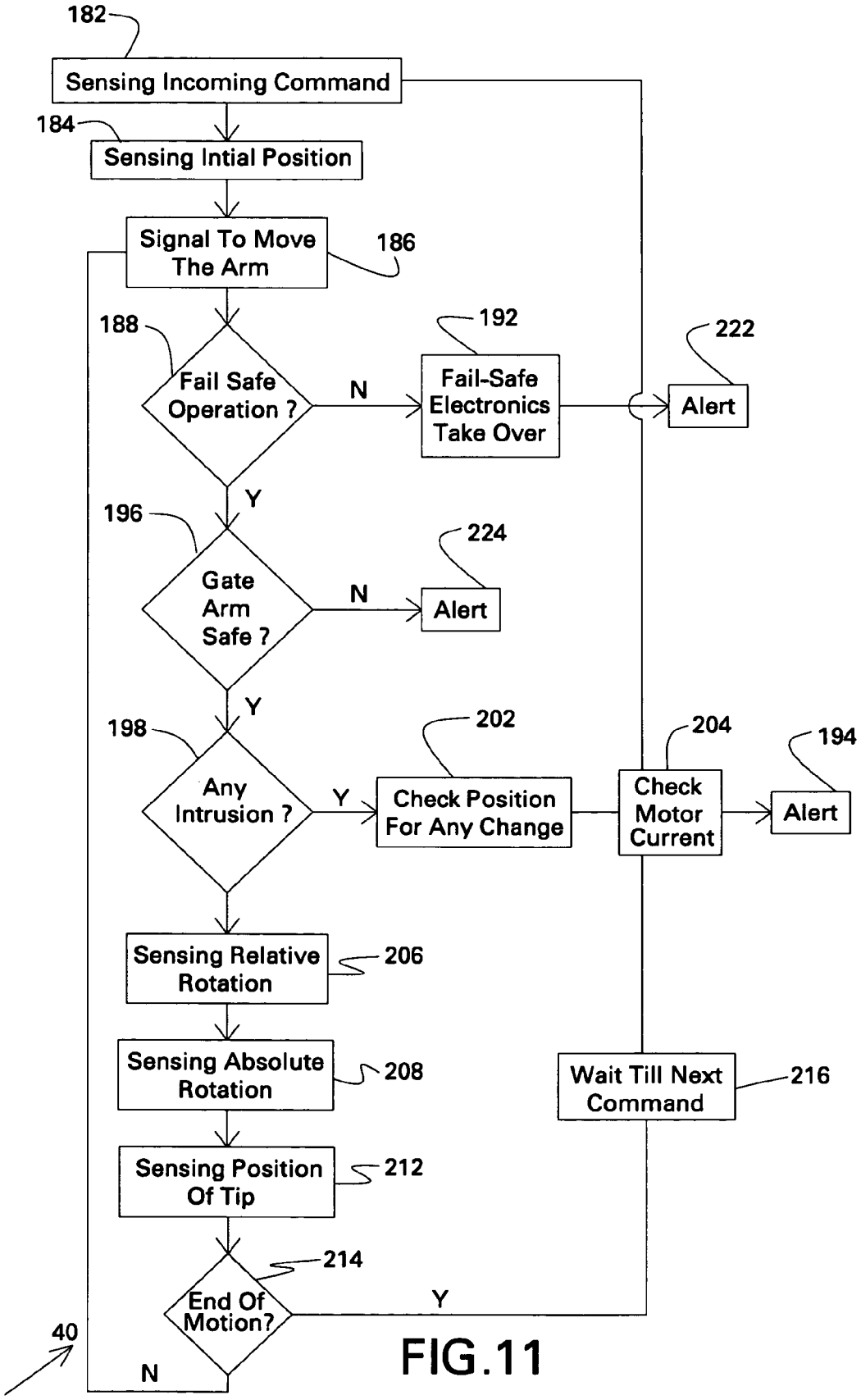
FIG. 11 illustrates a process for monitoring and controlling the grade crossing gate system of FIG. 2.

The overall operation of the system 20 is illustrated in FIG. 11 using a process flow chart. The process starts with sensing an incoming command as in step 182 followed by sensing an initial position of the gate arm 12 as in step 184. The controller 122 sends a signal to move the gate arm 12 in step 186. In step 188, it is determined whether the operation is fail-safe at all times. In case of any failure of operation, there is a take-over by the fail-safe electronics in step 192 and fail-safe takeover alert is activated in step 222. In a similar vein, safety of the gate arm 12 is assessed in step 196 and gate arm safety alert 224 is generated in case the gate arm 12 is sensed not to be safe any more. An intrusion on gate arm 12 is proactively sensed in step 198. This step includes checking for a change in the position of the gate arm 12 as in step 202 and checking for a change in the motor current 204 concurrently. At any time, if the position of the gate arms 12 does not change and the motor current also increases at the same time, it is confirmed that the motion of the gate arm 12 is intruded. Gate arm intrusion alert 226 is activated at that instant. The position of the gate arm 12 is continuously monitored by different non-contact methods e.g., by sensing relative rotation of gear as in step 206, sensing absolute rotation of shaft as in step 208, and sensing position of the tip of the gate arm 12 as in step 212. At the end of motion as in step 214, the controller 122 waits for a next command as in step 216. The micro-controller 124 of the controller 122 operates in two modes—"operation mode" and "maintenance mode". The mode is selected using a maintenance switch, operated by the maintenance/operational engineer.

Figure 12:
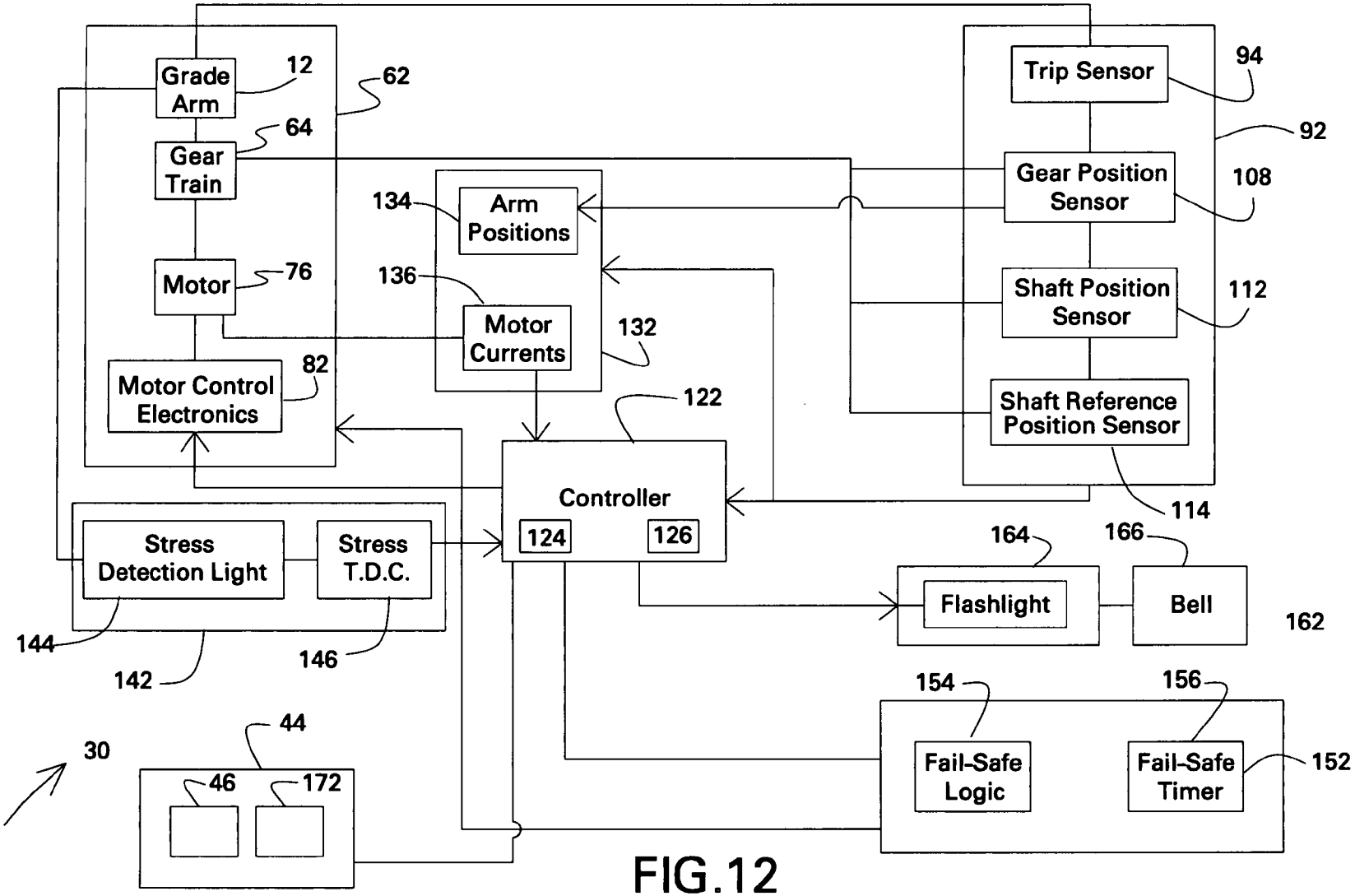
FIG. 12 is a block diagram of the grade crossing gate system constructed in accordance with another exemplary embodiment of the invention.

An alternative to the embodiment described in FIG. 2 is the use of a remote control unit to communicate with the gate arm controller of the grade crossing gate system remotely. FIG. 12 is a block diagram of a grade crossing gate system 30 constructed in accordance with this exemplary embodiment of the invention. The system 30 is similar to the system 20 of FIG. 2, except that this embodiment includes a remote control unit 44 to communicate with the gate arm controller 122 of the grade crossing gate system 30 from a remote location. The remote control unit 44 includes a microcontroller 46 and a power-line communication module 172. The power-line communication module 172 enables power-line communication between the remote control unit controller 46 and the gate arm controller 122.

Remote control unit 44 may take any form, such as a wireless, landline, and/or fiber optic communications system having a transmitter and a remote receiver. Remote control unit 44 may include and make use of access to the Internet or other global information network. A remote control unit controller 46, such as a computerized data processor or an analog micro-controller operated by a railroad or rail crossing service provider, may receive the communication signals from the controller 122. Communication signals from the controller 122 may be received by the remote control unit controller 46 regarding the operation or malfunction of a number of components or subsystems. The readiness of grade crossing gate systems throughout the network may thus be easily and automatically monitored at a central location. In another embodiment of the invention, the remote control unit may have an additional database to store different operational and field maintenance data in relation to different components, subsystems and the system 40. For example, data regarding the make, model, location, installation date, service history, etc. of each a component or a subsystem throughout the network may be maintained in a database accessible by the remote control unit controller 46. Similar communication may be transmitted from the remote control unit controller 46 to the grade crossing system controller 122 in relation to operation of a number of components or subsystems.

Figure 13:
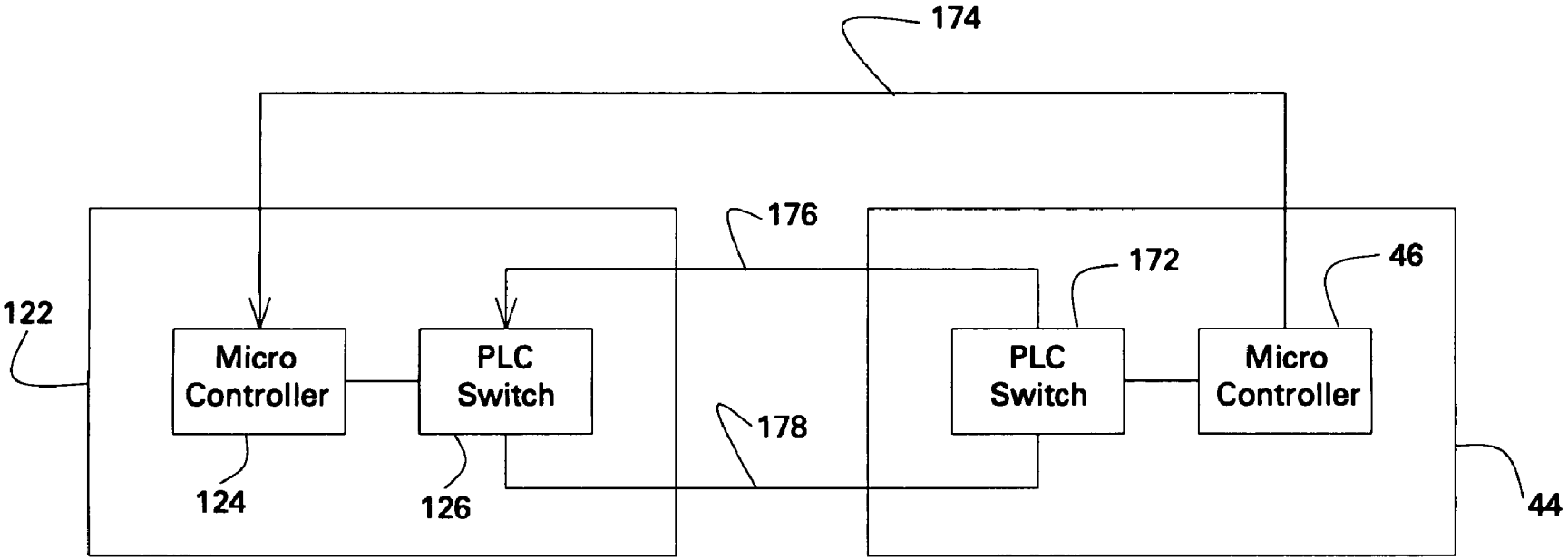
FIG. 13 is a block diagram of the controller in communication with a remote control unit shown in the system of FIG. 12.

FIG. 13 is a block diagram of the gate arm controller 122 in communication with the remote control unit 44 of FIG. 12. The communication lines in the system of FIG. 13 include a command carrying line 174, a power-line communication line 176 and a ground line 178. In a conventional electrical system, typically there are two communication lines between a receiving unit and a transmitting unit. One of the lines carries power and the other line is grounded. In the system of FIG. 13, in the power-line communication enabled mode, the power-line 176 is configured to additionally carry the intended communication between the gate arm controller 122 and the remote control unit 44. The two-way communication provided by the grade crossing gate system 30 of FIG. 12 may be used to augment the normal flow of control commands as well as to ensure better quality, reliability, maintainability and operability of the grade crossing gate system.

In other embodiments of the invention, it is possible to have various other communication modes including wireless, fiber optics, dedicated cable, etc., for communication between the gate arm controller 122 and the remote control unit or the wayside bungalow 44. Wireless communication mode further includes communication in radio frequency mode. Communication in wireless is helpful for applications, which are powered using solar panels. In such applications, power is supplied locally and there is no power line connecting the grade crossing gate system 30 and the remote control unit or the wayside bungalow 44. The communication between the grade crossing gate system 30 and remote control unit or the wayside bungalow 44 happens in such cases using wireless signals.

It is apparent that there has been provided in accordance with this invention, an electronically controlled grade crossing gate system and method. While the invention has been particularly shown and described in conjunction with a preferred embodiment thereof, it will be appreciated that variations and modifications can be effected by a person of ordinary skill in the art without and departing from the scope of the invention.

What is claimed is:

1. An electronically controlled grade crossing gate system, comprising:

a gate arm;

a gate arm moving assembly configured to move said gate arm;

a position sensor assembly configured to continuously sense a position of said gate arm; wherein said position sensor assembly is a non-contact position sensor assembly comprising a gear position sensor configured to measure an angular displacement of a gear assembly, a shaft position sensor configured to measure a rotation of a shaft of the gear assembly, a shaft reference position sensor configured to measure a movement of the shaft in relation to a stationary reference, and a tip position sensor coupled to a tip of said gate arm and configured to indicate a predetermined orientation mode of said gate arm; and a controller coupled to said gate arm moving assembly and said position sensor assembly, wherein said controller is configured to receive an incoming command related to said position of said gate arm, activate said gate arm moving assembly in response to said incoming command and communicate with said position sensor assembly to monitor said position of said gate arm.

2. The system according to claim 1, wherein said gate arm moving assembly comprises:

a gear assembly coupled to said gate arm;

a motor configured to drive said gear assembly; and motor control electronics configured to control said motor.

3. The system according to claim 2, wherein said motor comprises a transverse flux machine.

4. The system according to claim 1, further comprising a gate arm safety monitoring system coupled to said gate arm, wherein said gate arm safety monitoring system is configured to sense a predetermined safety attribute.

5. The system according to claim 4, further comprising a stress detecting element coupled to said gate arm and configured to sense said predetermined safety attribute.

6. The system according to claim 5, wherein said stress detecting element comprises a strain gauge.

7. The system according to claim 4, wherein said predetermined safety attribute relates to at least one of breakage, bending and cracking in said gate arm.

8. The system according to claim 4, wherein said gate arm safety monitoring system further comprises a warning system, wherein said warning system is configured to issue an alert when said predetermined safety attribute is sensed.

9. The system according to claim 8, wherein said alert is issued to a remotely located control unit.

10. The system according to claim 1, further comprising a gate arm intrusion detection system coupled to said gate arm and configured to detect an intrusion on said gate arm.

11. The system according to claim 10, wherein said gate arm intrusion detection system comprises a radio frequency (RF) transmitter and a RF receiver.

12. The system according to claim 10, wherein said gate arm intrusion detection system further comprises a warning system configured to issue an alert if said intrusion is sensed.

13. The system according to claim 12, wherein said alert is issued to a remotely located control unit.

14. The system according to claim 1, wherein said controller further comprises a micro-controller configured to generate a signal to control a movement of said gate arm.

15. The system according to claim 14, wherein said signal is a pulse width modulated signal.

16. The system according to claim 14, wherein said controller is further configured to gather and process field data in relation to operation of at least one of said gate arm, said gate arm moving assembly, said position sensor assembly and said micro-controller.

17. The system according to claim 14, wherein said controller is further configured to communicate in a power-line communication mode.

18. The system according to claim 14, wherein said controller is further configured to communicate in a wireless communication mode.

19. The system according to claim 14, further comprising a fail-safe electronics module coupled to said micro-controller, wherein said fail-safe electronics module is configured to operate in a fail-safe mode.

20. The system according to claim 19, wherein said fail-safe electronics module further comprises a warning system configured to issue an alert when said failure occurs.

21. The system according to claim 20, wherein said alert is issued to a remotely located control unit.

22. The system according to claim 1, wherein said predetermined orientation mode comprises a vertical orientation mode and a horizontal orientation mode.

23. The system according to claim 1, wherein said gear position sensor comprises a gear tooth sensor.

24. The system according to claim 1, further comprising an encoder disk coupled to said gear assembly, wherein said encoder disk is configured to provide a measurement of said angular displacement of said gear assembly.

25. The system according to claim 24, wherein said encoder disk comprises continuous pattern cuts along a circumference of said disk.

26. The system according to claim 24, wherein said encoder disk comprises sector cuts at a predetermined angular interval along a circumference of said disk.

27. An electronic system for controlling a grade crossing gate, comprising:

a gate arm;

a gate arm moving assembly configured to move said gate arm;

a position sensor assembly configured to sense continuously a position of said gate arm, wherein said position sensor assembly is a non-contact position sensor assembly comprising a gear position sensor configured to measure an angular displacement of a gear assembly, a shaft position sensor configured to measure a rotation of a shaft of the gear assembly, a shaft reference position sensor configured to measure a movement of the shaft in relation to a stationary reference, and a tip position sensor coupled to a tip of said gate arm and configured to indicate a predetermined orientation mode of said gate arm;

a controller, coupled to said gate arm moving assembly and said position sensor assembly, wherein said controller is configured to receive an incoming command related to said position of said gate arm, activate said gate arm moving assembly in response to said incoming command and communicate with said position sensor assembly to monitor said position of said gate arm; and a remotely located control unit configured to communicate with said controller to control and monitor the operation of said gate arm, said gate arm moving assembly, said position sensor assembly and/or said controller.

28. The system according to claim 27, wherein said remotely located control unit is configured to communicate in a power-line communication mode.

29. The system according to claim 27, wherein said remotely located control unit is configured to communicate in a wireless communication mode.

* * * * *